US008899382B2

(12) United States Patent
Kang et al.

(10) Patent No.: US 8,899,382 B2
(45) Date of Patent: Dec. 2, 2014

(54) OIL VALVE ASSEMBLY OF LINEAR COMPRESSOR

(75) Inventors: Kyoung-Seok Kang, Changwon-si (KR); Yangjun Kang, Changwon-si (KR); Min-Woo Lee, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 1554 days.

(21) Appl. No.: 12/087,769

(22) PCT Filed: Jan. 16, 2007

(86) PCT No.: PCT/KR2007/000270
§ 371 (c)(1),
(2), (4) Date: Dec. 22, 2008

(87) PCT Pub. No.: WO2007/081194
PCT Pub. Date: Jul. 19, 2007

(65) Prior Publication Data

US 2009/0095572 A1 Apr. 16, 2009

(30) Foreign Application Priority Data

Jan. 16, 2006 (KR) ..... 10-2006-0004658

(51) Int. Cl.

| | |
|---|---|
| ***F01M 1/00*** | (2006.01) |
| ***F16K 15/00*** | (2006.01) |
| ***F16K 17/00*** | (2006.01) |
| ***F16K 21/04*** | (2006.01) |
| ***F04B 39/10*** | (2006.01) |
| ***F04B 39/02*** | (2006.01) |

(52) U.S. Cl.
CPC ..... *F04B 39/1073* (2013.01); *F04B 39/0261* (2013.01); *F04B 39/0292* (2013.01); *F04B 39/1066* (2013.01)
USPC ..... 184/6.8; 137/512.15

(58) Field of Classification Search
CPC ..... F01M 9/10; F01M 1/02; F01M 1/04; F01M 201/083; F02F 1/20
USPC ..... 184/6.12, 6.8, 7.4, 6.16; 62/192, 193, 62/468; 137/512.15
See application file for complete search history.

(56) References Cited

U.S. PATENT DOCUMENTS 5,577,901 A * 11/1996 Yoon ..... 417/571
6,299,421 B1 * 10/2001 Oh et al. ..... 417/571

(Continued)

FOREIGN PATENT DOCUMENTS

CN 1637291 7/2005
KR 10-2001-0081660 8/2001

*Primary Examiner* — Henry Liu
(74) *Attorney, Agent, or Firm* — McKenna Long & Aldridge LLP

(57) ABSTRACT

The present invention discloses an oil supply valve assembly of a linear compressor including a shell, the oil being stored at the lower portion of the shell, a cylinder disposed in the shell, a piston disposed in the cylinder, a main body frame to which the cylinder is fixed, and a linear motor connected to the piston, for driving the piston, comprising: a passage formed in the main body frame, for supplying the oil to a gap between the cylinder and the piston; an oil valve being coupled to the main body frame to communicate with the passage, and including an oil suction valve and an oil discharge valve; and an oil cover coupled to overlap with the oil valve and communicate with the passage of the main body frame. By this configuration, the manufacturing process of the oil supply valve assembly is simplified and mis-assembly of the components is prevented by reducing the number of the components.

14 Claims, 3 Drawing Sheets

(56) References Cited

U.S. PATENT DOCUMENTS 6,508,637 B2 * 1/2003 Ohashi ..... 417/454
6,688,431 B2 * 2/2004 Oh ..... 184/6.16
6,827,561 B2 * 12/2004 Seo et al. ..... 417/571

* cited by examiner

RELATED ART

OIL VALVE ASSEMBLY OF LINEAR COMPRESSOR

This application claims priority to International application No. PCT/KR2007/000270 filed on Jan. 16, 2007 which claims priority to Korean Application No. 10-2006-0004658 filed Jan. 16, 2006, both of which are incorporated by reference, as if fully set forth herein.

TECHNICAL FIELD

The present invention relates to an oil supply valve assembly of a linear compressor which can supply oil to a gap between a cylinder and a piston for cooling, and more particularly, to an oil supply valve assembly of a linear compressor which can improve productivity by reducing a number of components by a structural change.

BACKGROUND ART

FIG. 1 is a side-sectional view illustrating a general oil supply apparatus of a linear compressor, and FIG. 2 is a disassembled perspective view illustrating a conventional oil supply valve assembly of the linear compressor.

Referring to FIG. 1, in the linear compressor, the oil is stored on an inside bottom surface of a shell 60 which is a hermetic space, a structure formed by coupling a cylinder 2, a piston 4 and a linear motor 70 to a main body frame 3 is elastically supported in the shell, an oil supply passage 12 and an oil recovery passage 14 are formed on the main body frame 3 to communicate with an oil circulation passage 10 formed between the cylinder 2 and the piston 4, and an oil pumping device 20 and an oil supply valve assembly 30 for supplying the oil to a gap between the cylinder 2 and the piston 4 are installed at one side of the main body frame 3 to communicate with the oil supply passage 12.

The main body frame 3 fixes the cylinder 2 and the linear motor. The piston 4 is linearly reciprocated between a top dead center (TDC) and a bottom dead center (BDC) inside the cylinder 2, for repeatedly performing a suction stroke for sucking a refrigerant into a compression space P formed between the piston 4 and the cylinder 2, and a compression stroke for compressing and discharging the refrigerant.

A suction valve 6 for sucking the refrigerant is installed on a communication hole (not shown) formed at one end of the piston 4, and a discharge valve assembly 8 is installed at the opened end of the cylinder 2. In the discharge valve assembly 8, a discharge valve 8*a* is elastically supported by a discharge valve spring 8*c* inside a discharge cap 8*b* fixed to the opened end of the cylinder 2, for opening and closing the opened end of the cylinder 2.

The oil supply passage 12 and the oil recovery passage 14 are formed in the main body frame 3 and the cylinder 2, for supplying or recovering the oil to/from the oil circulation passage 10 formed between the cylinder 2 and the piston 4. In the oil circulation passage 10, a ring-shaped cylinder groove 2*h* and a ring-shaped piston groove 4*h* are formed on the inner circumference of the cylinder 2 and the cuter circumference of the piston 4, respectively, to overlap with each other, for circulating the oil.

The oil supply passage 12 and the oil recovery passage 14 are formed to communicate with the cylinder groove 2*h*, especially, the TDC direction end of the cylinder groove 2*h*, respectively.

The oil pumping device 20 includes an oil inflow tube 21, and an oil cylinder 22 communicating with the oil inflow tube 21. A mass member 24 is elastically supported by a pair of oil springs 26*a* and 26*b* inside the oil cylinder 22. The oil inflow tube 21 is soaked in the oil stored on the bottom of the shell, and communicates with the oil supply passage 12.

One end of the oil cylinder 22 is fixedly inserted into a stepped mounting groove 3*h* formed on one surface of the main body frame 3 to communicate with the oil supply passage 12. A fixing cap 28 is fixedly inserted onto the other end of the oil cylinder 22. In the oil cylinder 22, the pair of oil springs 26*a* and 26*b* elastically support both ends of the mass member 24 between the main body frame 3 and the fixing cap 28.

As the piston 4 is linearly reciprocated inside the cylinder 2, the main body frame 3 is also vibrated, and as the mass member 24 is linearly reciprocated inside the oil cylinder 22, an inner pressure is varied. Therefore, the oil is sucked into the oil inflow tube 21 and circulated along the oil supply passage 12, the oil circulation passage 10 and the oil recovery passage 14.

As illustrated in FIG. 2, in the oil supply valve assembly 30, a gasket G for preventing oil leakage, an oil valve 34 for controlling oil supply, and an oil sheet 36 and an oil cover 38 for forming a storage space for temporarily storing the oil are assembled and bolt-fastened to a mounting part 32 formed on the other surface of the main body frame 3 to overlap with each other.

In detail, a suction storage groove 32*a* and a discharge storage groove 32*b* are formed on the mounting part 32 of the main body frame 3. A communication hole 32*h* communicating with the oil cylinder 22 and an oil discharge hole 32out communicating with the oil supply passage 12 are formed on the suction storage groove 32*a* and the discharge storage groove 32*b*, respectively. An oil suction hole 32 in communicating with the oil inflow tube 21 is formed at one side of the mounting part 32.

The oil valve 34 is formed in a metal plate shape. An oil suction valve 34*a* and an oil discharge valve 34*b* are formed at the lower center portion and upper center portion of the oil valve 34, respectively, to be movable in the forward and backward directions, by partially cutting the oil valve 34. An oil suction hole 34 in communicating with the oil suction hole 32 in of the mounting part 32 is formed at one side of the oil valve 34.

The oil sheet 36 is formed in a metal plate shape. A suction storage hole 36*a* opened and closed by a part of the oil suction valve 34*a* is formed at the lower portion of the oil sheet 36, and a discharge storage hole 36*b* contacting the other part of the oil suction valve 34*a* and the oil discharge valve 34*b* and being blocked by the oil discharge valve 34*b* is formed at the upper portion of the oil sheet 36.

An oil suction hole 36 in communicating with the oil suction hole 34 in of the oil valve 34 is formed on the oil sheet 36.

When the oil cover 38 is stacked on the oil sheet 36, a suction storage groove 38*a* is formed on the oil cover 38 to correspond to the suction storage hole 36*a* and the oil suction hole 36 in of the oil sheet 36, and a discharge storage groove 38*b* is formed on the oil cover 38 to correspond to the discharge storage hole 36*b* of the oil sheet 36. The suction storage groove 38*a* and the discharge storage groove 38*b* are isolated from each other. In addition, the suction storage groove 38*a* and the discharge storage groove 38*b* are protruded in the opposite direction to the oil sheet facing surface.

In the above-described oil supply valve assembly 30, the gasket Q the oil valve 34, the oil sheet 36 and the oil cover 38 are sequentially stacked on the mounting part 32 of the main body frame 3, and fixedly assembled to each other by bolts.

Accordingly, the oil pumping device 20 generates a pressure difference in the oil cylinder 22 by vibration caused by linear reciprocation of the piston 4 inside the cylinder 2. The oil is sucked into the oil inflow tube 21 communicating with the oil cylinder 22, and stored in the suction storage groove 38*a* of the oil cover 38. If one side pressure of the oil cylinder 22 increases, the oil suction valve 34*a* blocks the suction storage hole 36*a* of the oil sheet 36. Therefore, the oil is supplied from the suction storage groove 38*a* of the oil cover 38 to the discharge storage groove 38*b*.

At the same time, since the oil discharge valve 34*b* is opened due to a pressure difference between the discharge storage groove 38*b* of the oil cover 38 and the oil supply passage 12, the oil stored in the discharge storage groove 38*b* of the oil cover 38 is discharged to the oil supply passage 12 through the discharge storage groove 32*b* of the mounting part 32. The oil can be supplied by repeating the above process.

In the conventional oil supply valve assembly 30 of the linear compressor, the gasket G, the oil valve 34, the oil sheet 36 and the oil cover 38, which are relatively thin, are coupled to the mounting part 32 formed on the main body frame 3 to overlap with each other. Accordingly, the number of the components is large, the assembly process is complicated, and productivity is reduced.

DISCLOSURE OF INVENTION

Technical Problem

An object of the present invention is to provide an oil supply valve assembly of a linear compressor which can simplify an assembly process and improve productivity by reducing a number of components.

Technical Solution

There is provided an oil supply valve assembly of a linear compressor including a shell of which the oil being stored at the lower portion, a cylinder disposed in the shell, a piston disposed in the cylinder, a main body frame to which the cylinder is fixed, and a linear motor connected to the piston, for driving the piston, the oil supply valve assembly, comprising: a passage formed in the main body frame, for supplying the oil to a gap between the cylinder and the piston; an oil valve being coupled to the main body frame to communicate with the passage, and including an oil suction valve and an oil discharge valve; and an oil cover coupled to overlap with the oil valve and communicate pith the passage of the main body frame. By this configuration, the manufacturing process of the oil supply valve assembly is simplified and mis-assembly of the components is prevented by reducing the number of the components.

In another aspect of the present invention, the main body frame includes an oil suction hole for sucking the oil from the lower portion of the shell, and a suction storage groove for storing the sucked oil, and the oil cover includes a suction storage cap overlapping with the oil suction hole, the oil suction valve and a part of the suction storage groove. By this configuration, the oil sucked through the oil suction hole is stored in the suction storage cap, and supplied from the suction storage cap to the suction storage groove by opening and closing of the oil suction valve.

In another aspect of the present invention, the oil suction valve is disposed between the suction storage groove and the suction storage cap, and opens and closes the suction storage cap. The oil suction valve, the suction storage groove and the suction storage cap are disposed to cooperate with each other. In a state where one end of the oil suction valve is fixed, the other end thereof moves in the forward and backward directions to open and close the suction storage cap. By this configuration, the oil stored in the suction storage cap can flow to the suction storage groove.

In another aspect of the present invention, the main body frame includes a discharge storage groove to which the oil discharged from a discharge storage cap is supplied, and the oil cover includes the discharge storage cap overlapping with the oil discharge valve, the other part of the suction storage groove and the discharge storage groove. By this configuration, the oil can be supplied from the suction storage groove to the discharge storage cap.

In another aspect of the present invention, the oil discharge valve is disposed between the discharge storage groove and the discharge storage cap, for opening and closing the discharge storage cap. By this configuration, the oil can be supplied from the discharge storage cap to the discharge storage groove by opening and closing of the oil discharge valve.

In another aspect of the present invention, the main body frame includes a suction storage groove for storing the sucked oil, and a discharge storage groove to which the oil discharged from the discharge storage cap is supplied, and the suction storage groove is formed in an L shape with its part bent toward the discharge storage groove. By this configuration, the suction storage groove can communicate with the suction storage cap and the discharge storage cap.

In another aspect of the present invention, the oil valve further includes a hole communicating with the part of the suction storage groove bent toward the discharge storage groove, and the discharge storage cap covers the hole. By this configuration, the oil can be supplied from the suction storage groove to the discharge storage cap through the hole.

In another aspect of the present invention, the main body frame and the oil valve respectively include communication holes being formed to communicate with each other, for applying a pressure difference to the oil supply valve assembly, and the discharge storage cap communicates with the communication hole of the main body frame and the communication hole of the oil valve. By this configuration, the pressure is transferred through the communication hole of the main body frame and the communication hole of the oil valve, and the oil suction valve and the oil discharge valve are opened and closed by a pressure difference of both sides of the oil valve.

In another aspect of the present invention, the oil supply valve assembly further includes a gasket equivalent in shape to the oil valve coupling portion of the main body frame. By this configuration prevents oil leakage between the main body frame and the oil valve. In addition, when the main body frame, the oil valve and the oil cover are bolt-fastened, the gasket made of a ductile material is appropriately transformed to closely contact to the main body frame and the oil valve.

In another aspect of the present invention, the oil suction valve and the oil discharge valve are formed by cutting the oil valve to be movable in the forward and backward directions. In the oil suction valve and the oil discharge valve formed by partially cutting the oil valve, the cut portions can be moved due to the pressure difference of both sides of the oil valve generated by the communication hole. By this configuration, the oil suction valve and the oil discharge valve can open and close the suction storage cap and the discharge storage cap.

In addition, there is provided an oil supply valve assembly of a linear compressor including a shell, the oil being stored at the lower portion of the shell, a cylinder disposed in the shell, a piston disposed in the cylinder, and a linear motor connected to the piston, for driving the piston, comprising: a passage for supplying the oil to a gap between the cylinder and the piston; an oil valve being disposed on the passage, and including an oil suction valve and an oil discharge valve for controlling flow of the oil; an oil cover including a suction storage cap cooperating with the oil suction valve, and a discharge storage cap cooperating with the oil discharge valve; and a hole formed on the oil valve, for making the oil flow between the suction storage cap and the discharge storage cap. By this configuration, a member for forming the hole communicating with the suction storage cap and the discharge storage cap can be omitted. For example, the general oil sheet for making the suction storage cap and the discharge storage cap communicate with each other can be omitted.

In another aspect of the present invention, the discharge storage cap covers the hole. By this configuration, the oil flowing through the hole can be supplied to the discharge storage cap.

In another aspect of the present invention, the oil supply valve assembly further includes a suction storage groove for connecting the suction storage cap to the hole. By this configuration, since the oil stored in the suction storage cap is supplied to the hole through the suction storage groove, the amount of the oil stored in the oil supply valve assembly can be increased, and the oil can be stably supplied to the cylinder and the piston.

Advantageous Effects

In accordance with the present invention, in the oil supply valve assembly of the linear compressor, the oil valve for controlling oil supply and the oil cover for temporarily storing the oil are installed on the mounting part formed on the main body frame to overlap with each other. Therefore, productivity can be improved by reducing the number of the components and simplifying the assembly process. In order to secure the storage space, the oil cover is formed by welding a sheet member and a cover member in advance, thereby preventing mis-assembly.

MODE FOR THE INVENTION

An oil supply valve assembly of a linear compressor in accordance with the preferred embodiments of the present invention will now be described in detail with reference to the accompanying drawings.

Figure 3:
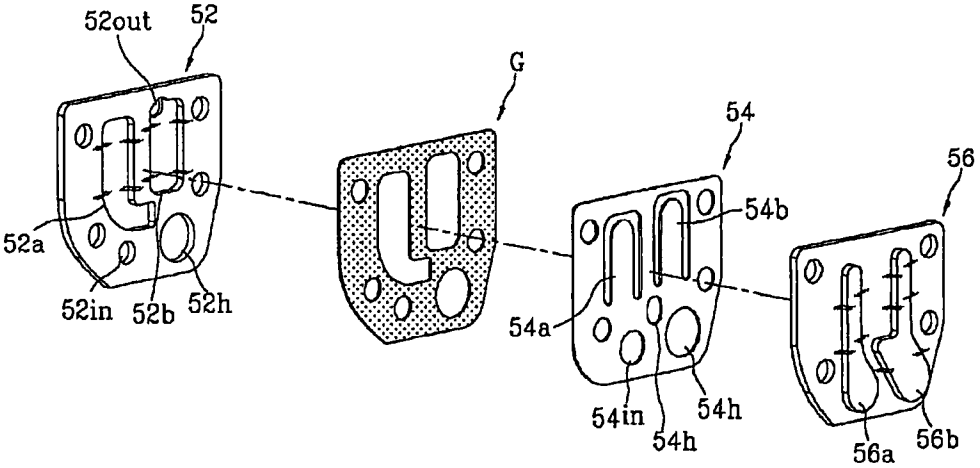
FIG. 3 is a disassembled perspective view illustrating an oil supply valve assembly of a linear compressor in accordance with the present invention.

FIG. 3 is a disassembled perspective view illustrating the oil supply valve assembly of the linear compressor in accordance with the present invention.

As illustrated in FIG. 3, in the oil supply valve assembly of the linear compressor, a gasket G for preventing oil leakage, an oil valve 54 for controlling oil supply, and an oil cover 56 for forming a storage space for temporarily storing the oil are bolt-fastened to a mounting part 52 to overlap with each other.

Figure 1:
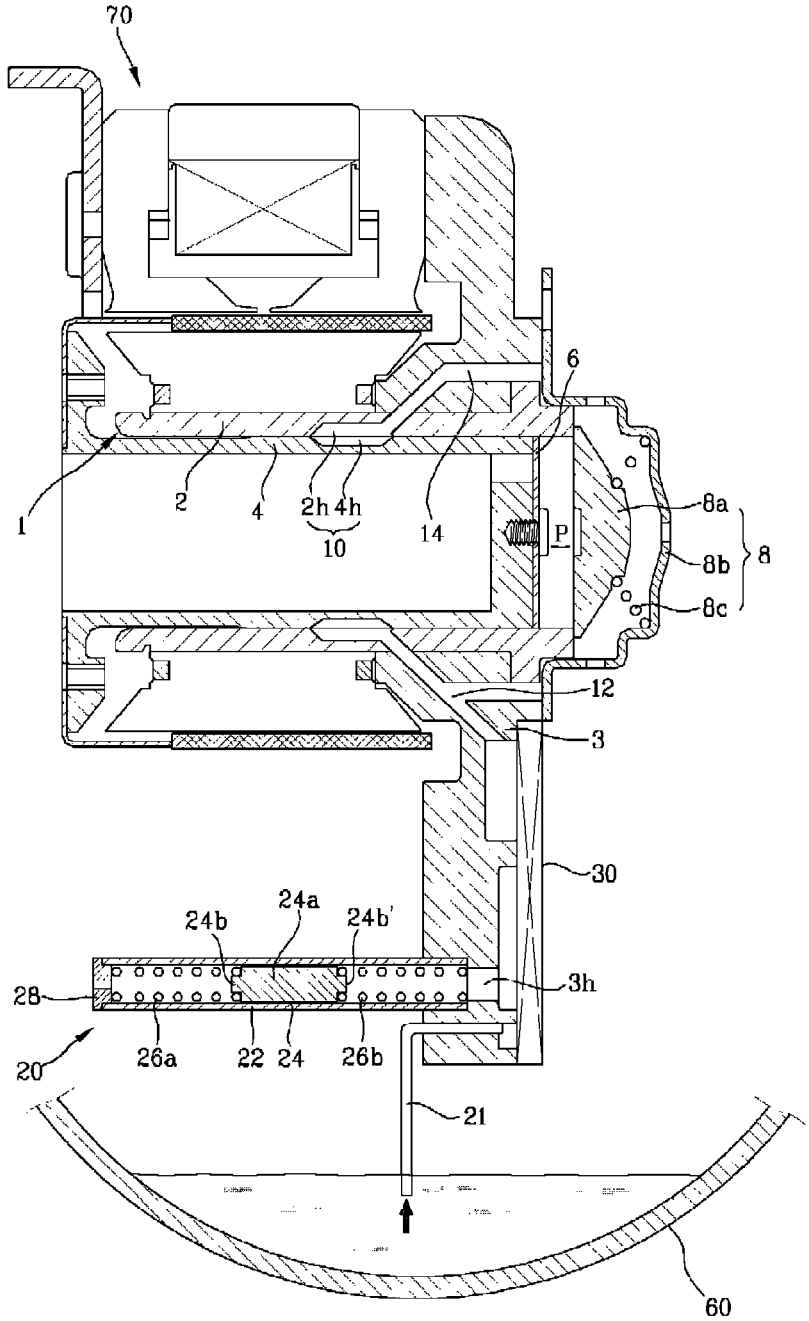
FIG. 1 RELATED ART
FIG. 1 is a side-sectional view illustrating a general oil supply apparatus of a linear compressor.
Figure 2:
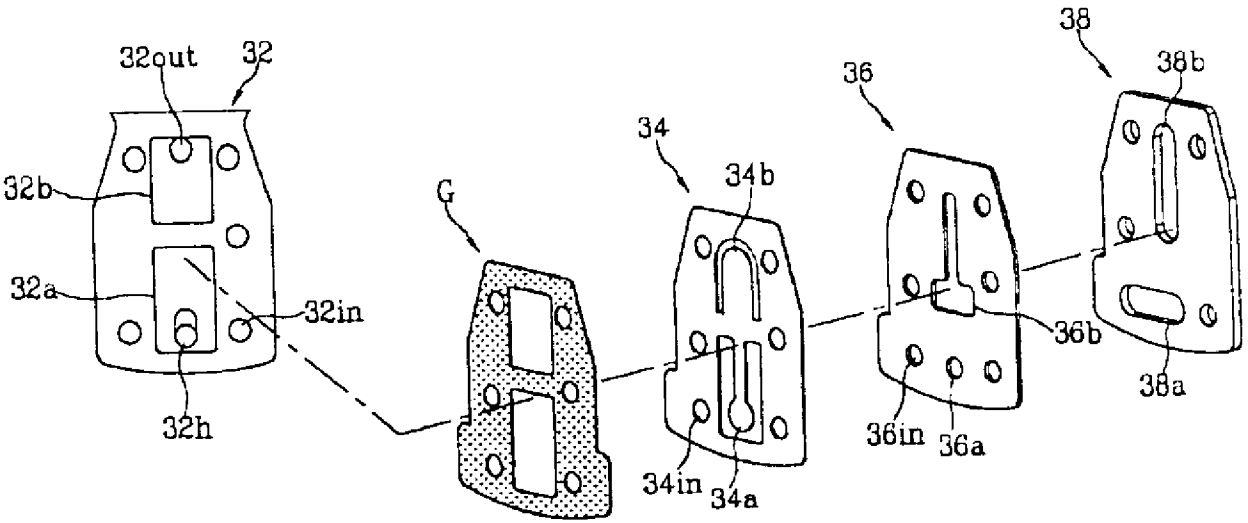
FIG. 2 is a disassembled perspective view illustrating a conventional oil supply valve assembly of the linear compressor.

As shown in FIG. 1, the mounting part 52 communicates with the conventional oil pumping device 20, the oil supply passage 12, the oil circulation passage 10 and the oil recovery passage 14. In the following description, the same reference numerals are used for the same elements as those of FIG. 1.

In more detail, a suction storage groove 52*a* and a discharge storage groove 52*b* are formed on the mounting part 52 side by side to be isolated from each other. The suction storage groove 52*a* is formed in an L shape with vertical and horizontal portions to partially surround the discharge storage groove 52*b*. The discharge storage groove 52*b* is formed in a straight line shape.

In the mounting part 52, an oil suction hole 52 in communicating with the oil inflow tube 21 to suck the oil is formed at the lower portion of the suction storage groove 52*a*, a communication hole 52*h* communicating with the oil cylinder 22 to generate a pressure difference is formed at the lower portion of the discharge storage groove 52*b*, and an oil discharge hole 52out communicating with the oil supply passage 12 to discharge the oil is formed on the discharge storage groove 52*b*.

The gasket G prevents oil leakage by firmly fixing the oil valve 54 and the oil cover 56 to the mounting part 52. Various holes are formed on the gasket G to correspond to the suction storage groove 52*a*, the discharge storage groove 52*b*, the oil suction hole 52 in and the communication cation hole 52*h* of the mounting part 52.

The oil valve 54 is formed in a thin plate shape and closely fixed to the mounting part 52. An oil suction valve 54*a* and an oil discharge valve 54*b* are formed to correspond to the suction storage groove 52*a* and the discharge storage groove 52*b*, by partially cutting the oil valve 54. In a state where the bottom ends of the oil suction valve 54*a* and the oil discharge valve 54*b* are fixed, the top ends thereof are moved in the forward and backward directions, for making the oil flow.

The oil suction valve 54*a* corresponds to the vertical portion of the suction storage groove 52*a*. The contour of the act groove formed on the circumference of the oil suction valve 54*a* is identical to the contour of the suction storage groove 52*a*. In addition, the contour of the cut groove formed on the circumference of the oil discharge valve 54*b* is identical to the contour of the discharge storage groove 52*b*.

An oil suction hole 54 in corresponding to the oil suction hole 52 in of the mounting part 52 is formed at the lower portion of the oil suction valve 54*a*. A communication hole 54*h* corresponding to the communication hole 52*h* of the mounting part 52 is formed at the lower portion of the oil discharge valve 54*b*. A hole 54*h* corresponding to the horizontal portion of the suction storage groove 52*a* is formed at the lower portion between the oil suction valve 54*a* and the oil discharge valve 54*b*.

The oil cover 56 is installed to overlap with the oil valve 54. A suction storage cap 56*a* for covering the oil suction valve 54*a* and a part of the suction storage groove 52*a*, and a discharge storage cap 56*b* for covering the oil discharge valve 54*b*, the other part of the suction storage groove 52*a*, and the discharge storage groove 52*b* are formed on the oil cover 56 to be isolated from each other.

The lower portion of the suction storage cap 56*a* is larger than the oil suction hole 54 in of the oil valve 54 to completely cover the oil suction hole 54 in of the oil valve 54. The upper portion of the suction storage cap 56*a* is smaller than the oil suction valve 54*a* of the oil valve 54 to be completely covered with the oil suction valve 54*a* of the oil valve 54. The upper and lower portions of the suction storage cap 56*a* communicate with each other.

The lower portion of the discharge storage cap 56*b* is larger than the regions of the communication hole 54*h* and the hole 54*h* of the oil valve 54 to completely cover the communication hole 54*h* and the hole 54*h* of the oil valve 54. The upper portion of the discharge storage cap 56*b* is smaller than the oil discharge valve 54*b* of the oil valve 54 to be completely covered with the oil discharge valve 54*b* of the oil valve 54. The upper and lower portions of the discharge storage cap 56*b* communicate with each other.

Four bolt holes are formed on the mounting part 52, the oil valve 54 and the oil cover 56, so that they can be bolt-fastened to each other. The gasket G, the oil valve 54 and the oil cover 56 are stacked on the mounting part 52 and fastened by bolts.

The operation of the oil supply valve assembly of the linear compressor in accordance with the present invention will now be described.

The piston 4 is linearly reciprocated inside the cylinder 2, for repeatedly sucking, compressing and discharging the refrigerant. The oil pumping device 20 is operated by vibration transferred along the main body frame 3, for pumping the oil in the shell.

In more detail, when a pressure difference is generated in the oil cylinder 22 by the oil pumping device 20 and transferred through the communication hole 52*h* of the mounting part 52 and the communication hole 54*h* of the oil valve 54, a pressure difference is generated between the discharge storage groove 52*b* of the mounting part 52 and the discharge storage cap 56*b* of the oil cover 56 with the oil discharge valve 54*b* therebetween. When the pressure difference is transferred through the hole 54*h* of the oil valve 54, a pressure difference is generated between the suction storage groove 52*a* of the mounting part 52 and the suction storage cap 56*a* of the oil cover 56 with the oil suction valve 54*a* therebetween.

The oil is sucked into the oil inflow tube 21 due to the pressure difference. At the same time, the oil supply valve 54*a* and the oil discharge valve 54*b* are opened or closed to supply the oil through the passage explained below.

That is, the oil sucked into the oil inflow tube 21 is stored in the suction storage cap 56*a* of the oil cover 56 through the oil suction hole 52 in of the mounting part 52 and the oil suction hole 54 in of the oil valve 54. When the oil suction valve 54*a* opens the upper portion of the suction storage cap 56*a* of the oil cover 56 die to the pressure difference, the oil is supplied from the suction storage cap 56*a* of the oil cover 56 to the suction storage groove 52*a* of the mounting part 52, and supplied to the lower portion of the discharge storage cap 56*b* of the oil cover 56 through the hole 54 of the oil valve 54.

When the oil discharge valve 54*b* opens the upper portion of the discharge storage cap 56*b* of the oil cover 56 due to the pressure difference, the oil is supplied from the discharge storage cap 56*b* of the oil cover 56 to the discharge storage groove 52*b* of the mounting part 52, discharged through the oil discharge hole 52out of the mounting part 52, and transferred along the oil supply passage 12, for performing cooling and lubrication between the cylinder 2 and the piston 4.

Although the preferred embodiments of the present invention have been described, it is understood that the present invention should not be limited to these preferred embodiments but various changes and modifications can be made by one skilled in the art within the spirit and scope of the present invention as hereinafter claimed.

The invention claimed is:

1. An oil supply valve assembly of a linear compressor including a shell of which the oil being stored at the lower portion, a cylinder disposed in the shell, a piston disposed in the cylinder, a main body frame to which the cylinder is fixed, and a linear motor connected to the piston for driving the piston, comprising:

a passage formed in the main body frame, for supplying the oil to a gap between the cylinder and the piston;

an oil valve coupled to the main body frame to communicate with the passage, and including an oil suction valve and an oil discharge valve; and an oil cover coupled directly to overlap with the oil valve and communicate with the passage of the main body frame, wherein the oil cover includes a suction storage cap and a discharge storage cap, wherein the oil suction valve directly contacting the oil cover opens a portion of the suction storage cap to supply the oil from the suction storage cap and the oil discharge valve directly contacting the oil cover opens a portion of the discharge storage cap to supply the oil from the discharge storage cap.

2. The oil supply valve assembly of claim 1, wherein the main body frame includes an oil suction hole for sucking the oil from the lower portion of the shell, and a suction storage groove for storing the sucked oil, and the suction storage cap overlaps with the oil suction hole, the oil suction valve and a part of the suction storage groove.

3. The oil supply valve assembly of claim 2, wherein the oil suction valve is disposed between the suction storage groove and the suction storage cap, and opens and closes the suction storage cap.

4. The oil supply valve assembly of claim 2, wherein the main body frame includes a discharge storage groove to which the oil discharged from the discharge storage cap is supplied, and the discharge storage cap overlaps with the oil discharge valve, the other part of the suction storage groove and the discharge storage groove.

5. The oil supply valve assembly of claim 4, wherein the oil discharge valve is disposed between the discharge storage groove and the discharge storage cap, and opens and closes the discharge storage cap.

6. The oil supply valve assembly of claim 1, wherein the main body frame includes a suction storage groove for storing the sucked oil, and a discharge storage groove to which the oil discharged from the discharge storage cap is supplied, wherein the suction storage groove is formed in an L shape, wherein a part of the suction storage groove is bent toward the discharge storage groove.

7. The oil supply valve assembly of claim 6, wherein the oil valve further includes a hole communicating with the part of the suction storage groove bent toward the discharge storage groove, and the discharge storage cap covers the hole.

8. The oil supply valve assembly of claim 1, further comprising a gasket equivalent in shape to the oil valve coupling portion of the main body frame.

9. The oil supply valve assembly of claim 1, wherein the oil suction valve and the oil discharge valve are formed by cutting the oil valve to be movable in the forward and backward directions.

10. An oil supply valve assembly of a linear compressor including a shell of which the oil being stored at the lower portion, a cylinder disposed in the shell, a piston disposed in the cylinder, a main body frame to which the cylinder is fixed, and a linear motor connected to the piston, for driving the piston, comprising:

a passage for supplying the oil to a gap between the cylinder and the piston;

an oil valve disposed on the passage, and including an oil suction valve and an oil discharge valve for controlling flow of this oil; and an oil cover including a suction storage cap cooperating the oil suction valve, and a discharge storage cap cooperating with the oil discharge valve, wherein the oil suction valve directly contacting the oil cover opens a portion of the suction storage cap to supply the oil from the suction storage cap and the oil discharge valve directly contacting the oil cover opens a portion of the discharge storage cap to supply the oil from the discharge storage cap.

11. The oil supply valve assembly of claim 10, wherein the discharge storage cap covers the hole.

12. The oil supply valve assembly of claim 10, further comprising a suction storage groove for connecting the suction storage cap to the hole.

13. The oil supply valve assembly of claim 1, further comprising a communication hole formed at the main body frame and at the oil valve, respectively, for communicating with an oil cylinder inserted into the main body frame, wherein the oil cylinder generates a pressure difference, wherein the discharge storage cap communicates with the communication hole of the main body frame and the communication hole of the oil valve, and wherein the pressure difference transferred through the communication holes to the discharge storage cap opens and closes the oil suction valve and the oil discharge valve, respectively.

14. The oil supply valve assembly of claim 10, further comprising a communication hole formed at the main body frame and at the oil valve, respectively, for communicating with an oil cylinder inserted into the main body frame, wherein the oil cylinder generates a pressure difference, wherein the discharge storage cap communicates with the communication hole of the main body frame and the communication hole of the oil valve, and wherein the pressure difference transferred through the communication holes to the discharge storage cap opens and closes the oil suction valve and the oil discharge valve, respectively.

* * * * *